US010577968B2

(12) United States Patent
Bueno et al.

(10) Patent No.: US 10,577,968 B2
(45) Date of Patent: Mar. 3, 2020

(54) DRY STEAM CLEANING A SURFACE

(71) Applicant: General Electric Company, Schenectady, NY (US)

(72) Inventors: Manuel Kenneth Bueno, Syracuse, NY (US); Daniel Thomas Harvell, Cornelius, NC (US); Gregory Douglas Troutman, Huntersville, NC (US); Carlo Angelo Yon, Atlanta, GA (US)

(73) Assignee: General Electric Company, Schenectady, NY (US)

( * ) Notice: Subject to any disclaimer, the term of this patent is extended or adjusted under 35 U.S.C. 154(b) by 23 days.

(21) Appl. No.: 13/907,109

(22) Filed: May 31, 2013

(65) Prior Publication Data

US 2014/0352727 A1 Dec. 4, 2014

(51) Int. Cl.

| | |
|---|---|
| ***F01D 25/00*** | (2006.01) |
| ***B08B 3/00*** | (2006.01) |
| ***B05B 1/04*** | (2006.01) |

(52) U.S. Cl.

CPC ..... *F01D 25/002* (2013.01); *B08B 3/00* (2013.01); *B05B 1/044* (2013.01)

(58) Field of Classification Search

CPC ..... B05B 1/044

See application file for complete search history.

(56) References Cited

U.S. PATENT DOCUMENTS 3,276,694 A * 10/1966 Alexander ..... 239/101
3,833,010 A * 9/1974 McDermott ..... B08B 9/093 134/22.18
3,923,253 A * 12/1975 Stewart ..... B05B 1/3426 239/463
4,284,242 A * 8/1981 Randell ..... 239/422
4,893,752 A * 1/1990 Spink ..... B05B 7/08 239/427.3
5,607,349 A * 3/1997 Karubian ..... A22B 5/0082 452/173
5,685,917 A * 11/1997 Sangeeta ..... 134/2
5,944,483 A * 8/1999 Beck ..... F01D 25/002 134/104.1
5,961,053 A * 10/1999 Raghavan ..... B05B 1/04 239/599
7,967,918 B2 * 6/2011 Collin et al. ..... 134/167 R
2005/0126487 A1 * 6/2005 Tabuchi et al. ..... 118/723 E
2007/0246574 A1 * 10/2007 Kolb ..... B01J 4/002 239/567
2008/0277507 A1 * 11/2008 Fulkerson ..... B05B 5/032 239/704

(Continued)

OTHER PUBLICATIONS https://www.youtube.com/watch?v=Px2anroCpD4; Nov. 29, 2011.*

(Continued)

*Primary Examiner* — Mikhail Kornakov
*Assistant Examiner* — Pradhuman Parihar
(74) *Attorney, Agent, or Firm* — Mintz Levin Cohn Ferris Glovsky and Popeo, P.C.

(57) ABSTRACT

A device and method for cleaning a surface using dry steam is disclosed. A dry steam wand is fitted with a custom nozzle that permits the dry steam to be angled to clean difficult to access surfaces of a gas turbine. The nozzle includes a slit that is configured to maintain sufficient temperature and pressure to effectively remove contaminants found on gas turbines.

7 Claims, 9 Drawing Sheets

(56) References Cited

U.S. PATENT DOCUMENTS

2009/0011123 A1* 1/2009 Bunting et al. ..... 427/142

OTHER PUBLICATIONS http://www.amerivap.com/testimonials.htm; Nov. 15, 2011 provided by Wayback Machine.com.*

Amerivap, What is a Dry Steam Cleaner and How Does it Clean and Sanitize Without Chemicals, Published Nov. 29, 2011, [online], [retrieved on Dec. 12, 2016], <https://www.youtube.com/watch?v=Px2anroCpD4>.*

* cited by examiner

DRY STEAM CLEANING A SURFACE

BACKGROUND OF THE INVENTION

The subject matter disclosed herein relates to cleaning surfaces, including internal surfaces of gas turbines.

During operation of certain gas turbines, contaminants are often pulled into the turbine through inlets and may accumulate in internal, difficult to access places, such as rotors, compressors, lower and upper half shells and the like. Additionally, combustion byproducts of the consumed fuel may also accumulate in these places. Contaminants may negatively impact the efficiency of the turbine.

To maximize the efficiency of the turbine, it is desirable to periodically clean the internal, difficult to access places of the turbine. As cleaning necessarily results in downtime as the turbine is taken offline, it is desirable to minimize downtime by rapidly, yet thoroughly, cleaning the turbine.

Conventional cleaning techniques include hand-cleaning, dry ice cleaning and cleaning with wet steam. Hand-cleaning is the most common technique, but also the least effective. A significant amount of contaminants often remain in the difficult to access places. Dry ice cleaning is more effective than hand-cleaning but requires the use of several thousand pounds of dry ice be consumed. The logistics of keeping such a large amount of dry ice is problematic due to constant sublimation and large storage space. Wet steam cleaning is also more effective than hand-cleaning, but produces many gallons of waste water. The removal of such a large volume of waste water is a significant problem as the water is slow to evaporate.

The discussion above is merely provided for general background information and is not intended to be used as an aid in determining the scope of the claimed subject matter.

BRIEF DESCRIPTION OF THE INVENTION

A device and method for cleaning a surface using dry steam is disclosed. A dry steam wand is fitted with a custom nozzle that permits the dry steam to be angled to clean difficult to access surfaces of a gas turbine. The nozzle includes a slit that is configured to maintain sufficient temperature and pressure to effectively remove contaminants found on gas turbines. An advantage that may be realized in the practice of some disclosed embodiments of the nozzle is that gas turbine contaminants may be efficiently removed from difficult to access surfaces. Conventional nozzles were found to be ineffective for such an application.

In one embodiment, a method of cleaning a surface is disclosed. The method comprises conducting dry steam through a wand, and directing the dry steam at an acute angle relative to a longitudinal axis of the wand to clean the surface.

In another embodiment, a method of cleaning an internal surface of a gas turbine is disclosed. The method comprises conducting dry steam through a wand, directing, with a nozzle fluidly connected to the wand, the dry steam at an acute angle relative to a longitudinal axis of the wand to clean the surface, and positioning the nozzle proximate to the internal surface to maintain a temperature of greater than 350 degrees F. at the internal surface.

In yet another embodiment, a nozzle for a dry steam cleaner is disclosed. The nozzle comprises a cavity having a central longitudinal axis, and a slit in the nozzle that is spaced apart from the central longitudinal axis and accesses the cavity.

This brief description of the invention is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION OF THE INVENTION

Disclosed in this specification is a method and device for cleaning a surface using dry steam. Dry steam is a term of art that refers to steam with a low (e.g., less than about 3%) moisture content. The method uses a specially designed nozzle to deliver dry steam to a surface for the purpose of removing contaminants deposited thereon. The nozzle permits the dry steam to be delivered at a certain pressure (e.g., greater than about 160 pounds per square inch (psi) or 1103 kPa (kilopascals)) and at a certain temperature (e.g., greater than about 350° F.). Conventional nozzles are unable to achieve these pressures and temperatures. The method and device are particularly suitable for cleaning internal surfaces of gas turbines.

Figure 1:
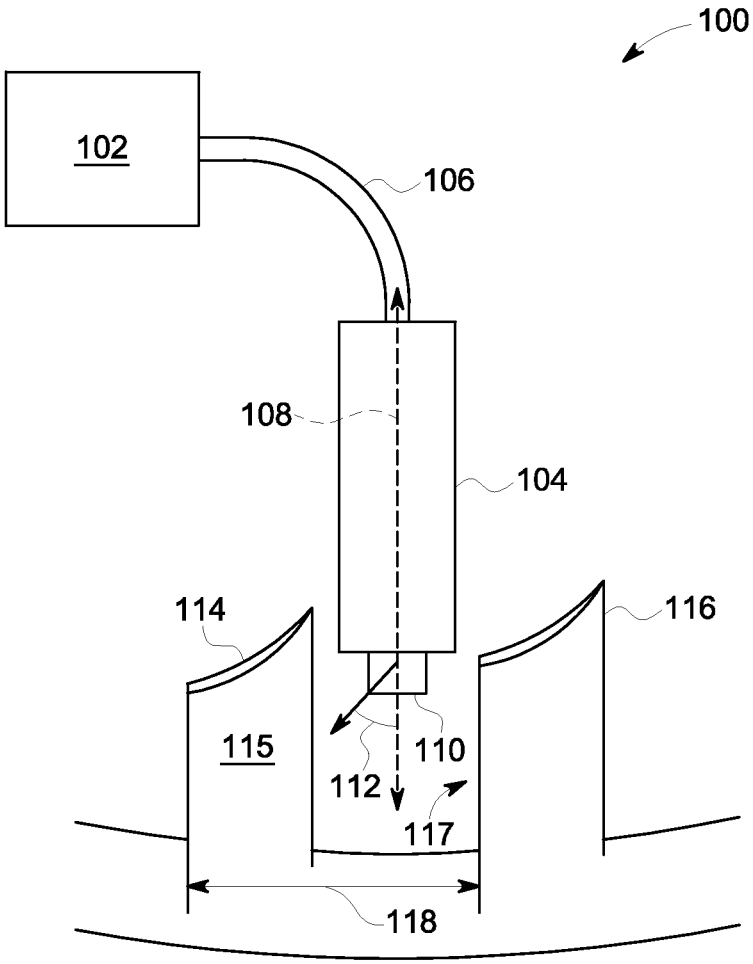
FIG. 1 depicts an exemplary system for dry steam cleaning a surface.

FIG. 1 depicts an exemplary system 100 for dry steam cleaning a surface. The system 100 comprises a dry steam boiler 102 for producing dry steam. Such dry steam boilers are commercially available. An elongated wand 104 is in fluid communication with the dry steam boiler 102 by a hose 106, the elongated wand 104 having a longitudinal axis 108. A nozzle 110 is connected to the wand 104. The nozzle 110 has a slit (not shown) that direct dry steam at an angle 112 relative to the longitudinal axis 108 of the wand 104. FIG. 1 also depicts a pair of substrates 114, 116 separated by a narrow gap 118. In use, the nozzle 110 may be inserted into the narrow gap 118. Since the dry steam is directed at an angle 112, difficult to access surfaces (e.g., 115, 117) may be cleaned. The nozzle 110 permits the dry steam to be delivered at a certain pressure (e.g., greater than about 160 pounds per square inch (psi) or 1103 kPa (kilopascals))) and at a certain temperature (e.g., greater than about 350° F.). Conventional nozzles have openings that do not satisfy the parameters discussed in this specification and proved to be ineffective for this purpose as the proper temperature and pressure could not be maintained. The nozzle 110 may be formed of any suitable material including, but not limited to, metals such as stainless steel.

Figure 2:
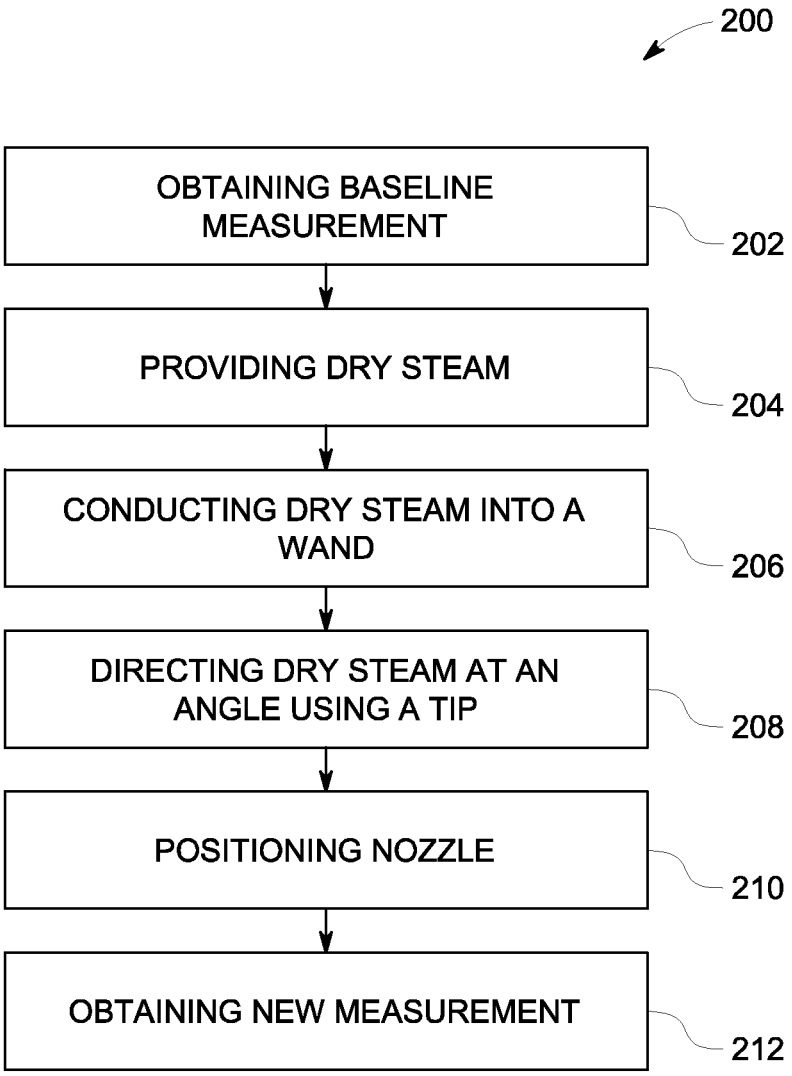
FIG. 2 is a flow diagram of an exemplary method for cleaning a surface.
Figure 3:
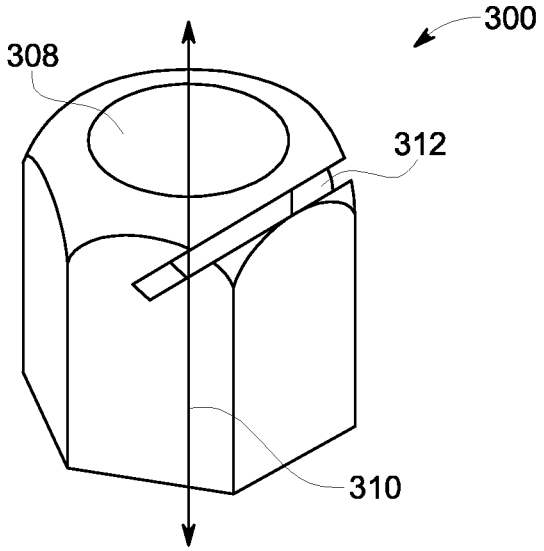
FIG. 3 is a perspective view of an exemplary nozzle for a dry steam cleaner.
Figure 4:
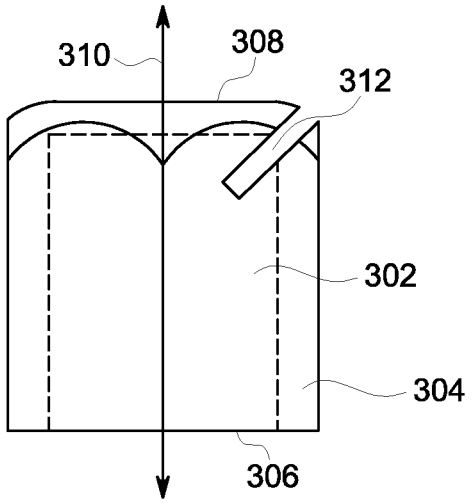
FIG. 4 is a side view of the nozzle of FIG. 3.
Figure 5:
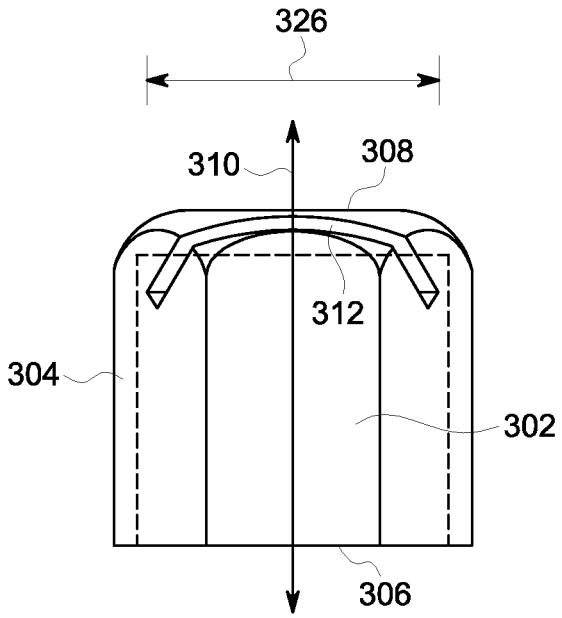
FIG. 5 is a front view of the nozzle of FIG. 3.
Figure 6:
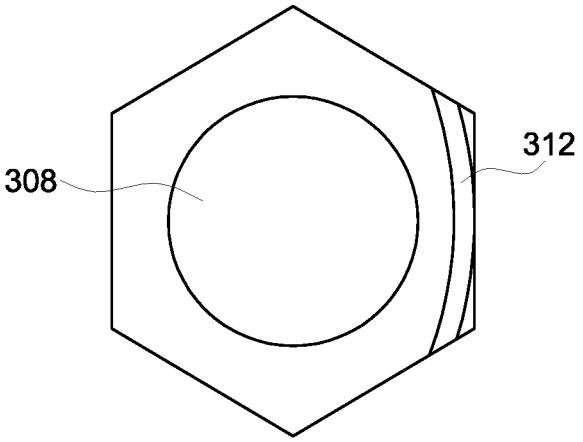
FIG. 6 is a top view of the nozzle of FIG. 3.

FIG. 2 is a flow diagram of an exemplary method 200 for cleaning a surface. In one embodiment, the surface is an internal surface of a gas turbine. Examples of internal surfaces include rotors, compressors, lower and upper half shells, etc. The method 200 comprises a step 202 of obtaining a baseline measurement of the amount of contaminants on a surface of a substrate. For example, the thickness of the surface may be measured using a caliper or other suitable measuring device. The thickness includes the thickness of both the substrate and the contaminants. The method 200 also comprises a step 204 of providing dry steam from a dry steam boiler. In step 206, the dry steam is conducted into a wand through a hose. The wand has a longitudinal axis and a nozzle, such as nozzle 300 of FIG. 3, at a terminal end of the wand that directs the dry steam. In step 208, the dry steam is directed by the nozzle at an acute angle relative to the longitudinal axis of the wand. In step 210, the nozzle is positioned proximate the surface to be cleaned. In one embodiment, the nozzle is positioned within one inch (2.54 cm) of the surface to be cleaned. In step 212 a new measurement of the amount of contaminants on the surface is obtained. The new measurement may be compared to the baseline measurement to provide a quantitative indication of the success of the cleaning method.

Figure 7:
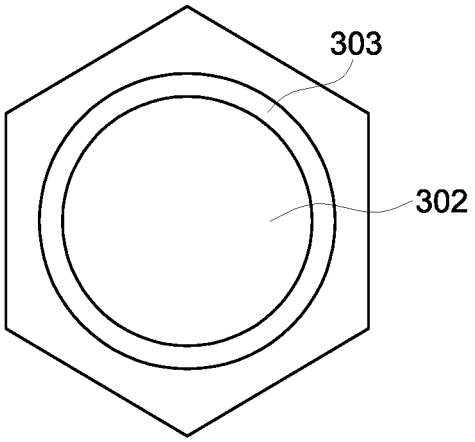
FIG. 7 is a bottom view of the nozzle of FIG. 3.

FIGS. 3-7 are various views of an exemplary nozzle 300 for a dry steam cleaner. The nozzle 300 has a cavity 302 that is defined by at least one sidewall 304, an open bottom face 306 and a top face 308. The inner surface of the cavity 302 has threads 303 for connecting to a wand (not shown). The cavity 302 defines a central longitudinal axis 310. The nozzle 300 has a slit 312 that is spaced from the central longitudinal axis 310 and fluidly connects to the cavity 302. In this fashion, dry steam that is introduced to the cavity 302 exits the slit 312 and is directed toward a surface to be cleaned. In the embodiment of FIG. 7, the nozzle 300 comprises six flat sidewalls disposed at angles to provide a hexagonal nozzle and is well suited for use with a wrench. In alternate embodiments, more or fewer sidewalls may be present to provide nozzles with other shapes. For example, a single sidewall that is curved may be present to provide a cylindrical nozzle. The exemplary nozzle 300 is shown wherein the slit 312 has an opening 313 at an interface 315 formed by the sidewall 304 and the top face 308. In alternate embodiments, the slit opens on the sidewall.

Figure 8:
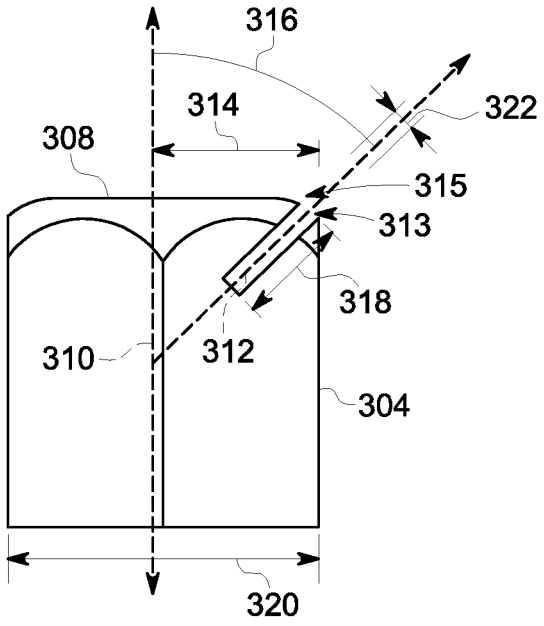
FIG. 8 is a side view of the nozzle of FIG. 3 showing certain parameters.

In the embodiment of FIG. 8, the slit 312 is spaced apart from the central longitudinal axis 310 by a distance 314. The slit 312 forms an angle 316 with the central longitudinal axis. In one embodiment, the angle 316 is an acute angle. In another embodiment, the angle 316 is between about thirty-five and fifty-five degrees. In the exemplary embodiment of FIG. 8, the angle 316 is about forty-five degrees.

Figure 9:
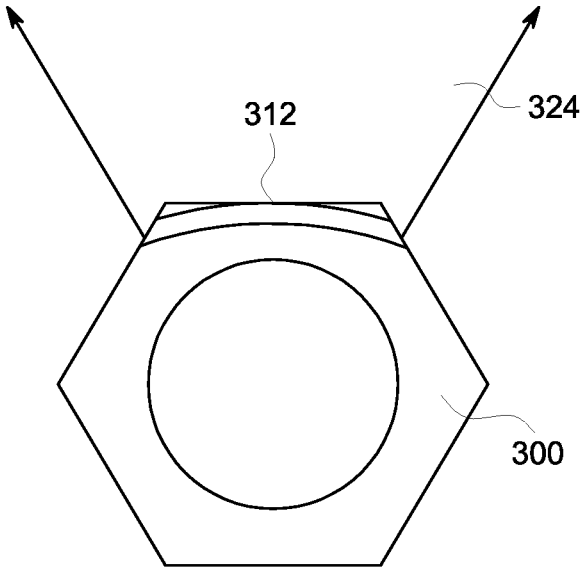
FIG. 9 is a top view of the nozzle of FIG. 3 showing a dovetail pattern of dry steam.

The slit 312 has a depth 318 of between about 20% and 50% of a nozzle width 320 of the nozzle 300 such that the slit 312 extends into the sidewall 104. For example, the nozzle width 320 may be 0.625 inches (15.9 mm) and the depth 318 may be about 0.25 inches (6.4 mm), which is approximately 40% of the nozzle width 320. The slit has a slit width 322 that is between about 15% and about 30% of the depth 318. For example, when the depth 318 is about 0.25 inches (6.4 mm) the slit width 322 may be about 0.063 inches (1.6 mm, 25%). By way of further example, when the depth 318 is about 0.25 inches (6.4 mm) the slit width 322 may be about 0.045 inches (1.1 mm, 18%). The slit 312 has a length 326 (see FIG. 5) that traverses at least 50% of the nozzle width 320. As shown in FIG. 9, the slit 312 is configured to project dry steam in a dovetail pattern 324. The dovetail pattern 324 exposes a relatively wide area of the surface to be cleaned to the dry steam.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of cleaning a surface on a gas turbine, the method comprising:

conducting dry steam through a wand having a nozzle comprising a cavity defined by a top face and a plurality of sidewalls, the cavity having a central longitudinal axis, each of the plurality of sidewalls extending parallel to the central longitudinal axis, and a linear slit in the nozzle that is spaced apart from the central longitudinal axis and extending into at least two sidewalls to define a depth, the linear slit extending across the top face from a first sidewall to a second sidewall to define a length, the linear slit accessing the cavity;

directing the dry steam at an acute angle relative to a longitudinal axis of the wand to clean the surface on the gas turbine; and positioning the nozzle proximate to the surface to maintain a temperature of greater than 350 degrees C. and a pressure of greater than 160 pounds per square inch (psi) or 1103 kPa (kilopascals) at the surface, wherein the acute angle is formed by the linear slit and the central longitudinal axis of the cavity, and the acute angle is between 35 and 55 degrees, and wherein the linear slit has a depth that is between 20% and 50% of a nozzle width, and a width that is between 15% and 30% of the depth;

wherein the step of positioning the nozzle positions the nozzle within an inch of the surface.

2. The method of claim 1, wherein the surface is an internal surface of the gas turbine.

3. The method of claim 1, further comprising obtaining a baseline measurement of contaminants prior to cleaning and obtaining a new measurement of contaminants after cleaning.

4. The method of claim 1, wherein the acute angle is between 40 and 50 degrees.

5. A method of cleaning an internal surface of a gas turbine, the method comprising:

conducting dry steam through a wand;

directing, with a wand fluidly connected to the wand, the dry steam at an acute angle relative to a longitudinal axis of the wand to clean the internal surface of the gas turbine, the nozzle comprising a cavity defined by a top face and a plurality of sidewalls, the cavity having a central longitudinal axis, each of the plurality of sidewalls extending parallel to the central longitudinal axis, and a linear slit extending into at least two sidewalls to define a depth and extending across the top face from a first sidewall to a second sidewall to define a length, the linear slit spaced apart from the central longitudinal axis, the linear slit accessing the cavity; and positioning the nozzle proximate to the internal surface to maintain a temperature of greater than 350 degrees C. and a pressure of greater than 160 pounds per square inch (psi) or 1103 kPa (kilopascals) at the internal surface, wherein the acute angle is formed by the linear slit and the central longitudinal axis of the cavity and the acute angle is between 35 and 55 degrees, and wherein the linear slit has a depth that is between 20% and 50% of a nozzle width, and a width that is between 15% and 30% of the depth;

wherein the step of positioning the nozzle positions the nozzle within an inch of the internal surface.

6. The method of claim 5, further comprising obtaining a baseline measurement of contaminants prior to cleaning and obtaining a new measurement of contaminants after cleaning.

7. The method of claim 5, wherein the acute angle is between 40 and 50 degrees.

* * * * *